United States Patent [19]

Kariya et al.

[11] Patent Number: 4,972,119

[45] **Date of Patent: * Nov. 20, 1990**

[54] CERAMIC ENVELOPE DEVICE FOR HIGH-PRESSURE DISCHARGE LAMP, AND METHOD FOR PRODUCING THE SAME

[75] Inventors: Mikio Kariya; Hirotsugu Izumiya, both of Nagoya, Japan

[73] Assignee: NGK Insulators, Ltd., Japan

[ * ] Notice: The portion of the term of this patent subsequent to May 30, 2006 has been disclaimed.

[21] Appl. No.: 323,949

[22] Filed: Mar. 15, 1989

[30] Foreign Application Priority Data

Mar. 16, 1988 [JP] Japan ..... 63-62238

[51] Int. Cl.[5] ..... H01J 9/26; H01J 61/36; H01J 61/30

[52] U.S. Cl. ..... 313/624; 313/625; 313/634; 445/22; 445/26

[58] Field of Search ..... 313/623, 624, 625, 634; 445/22, 26

[56] References Cited

U.S. PATENT DOCUMENTS

| | | | |
|---|---|---|---|
| 4,155,757 | 5/1979 | Hing . | |
| 4,155,758 | 5/1979 | Evans et al. . | |
| 4,665,344 | 5/1987 | Kajihara et al. | 313/624 |
| 4,687,969 | 8/1987 | Kajihara et al. | 313/625 |
| 4,694,219 | 9/1987 | Hing | 313/624 X |
| 4,808,881 | 2/1989 | Kariya et al. | 313/624 |

FOREIGN PATENT DOCUMENTS 62-176043 8/1987 Japan .

*Primary Examiner*—Palmer C. DeMeo

*Attorney, Agent, or Firm*—Arnold, White & Durkee

[57] ABSTRACT

A ceramic envelope device for an HID lamp, wherein a translucent ceramic arc tube is closed at opposite end sections thereof by respective end caps which support respective discharge electrodes on their inner surfaces. At least one of the opposite end sections of the arc tube is sealed with a sealing layer, and each of the sealed end section of the tube includes a first axial portion having a first inside diameter, and a second axial portion having a second inside diameter smaller than the first inside diameter and disposed axially inwardly of the first axial portion. The first and second axial portions define an annular shoulder surface radially inwardly extending between the first and second inside diameters. The first axial portion preferably has a cylindrical wall thickness of 1.0–1.5 mm, and the annular shoulder surface preferably has a radial width of 0.2–0.8 mm. The sealing layer is interposed between the first axial portion of the arc tube and the corresponding end cap. The inner surface of the corresponding end cap includes a peripheral portion held in abutting contact with the annular shoulder surface. The first and second inside diameters are preferably formed by a stepped-diameter drill.

10 Claims, 2 Drawing Sheets

CERAMIC ENVELOPE DEVICE FOR HIGH-PRESSURE DISCHARGE LAMP, AND METHOD FOR PRODUCING THE SAME

BACKGROUND OF THE INVENTION

1. Field of the Invention

The present invention relates generally to a ceramic envelope device used in a high-pressure metal vapor discharge lamp (hereinafter referred to as "HID" lamp; "HID" representing High Intensity Discharge), and a method for producing the ceramic envelope device. More particularly, the invention is concerned with the structure of one or both ends of such a ceramic envelope device at which a translucent ceramic arc tube is closed by an end cap and sealed by a sealing layer, and a method suitable for producing this ceramic envelope device.

2. Discussion of the Prior Art

In the art of such HID lamps using a translucent ceramic arc tube, end caps are inserted in the opposite end portions of the arc tube so as to close the open ends, and support discharge electrodes on their inner surfaces. Such end caps are formed of an electrically conductive cermet material as disclosed in U.S. Pat. Nos. 4,155,757 and 4,155,758, or consist of a laiminar structure wherein an electrically conductive layer is interposed between a plurality of ceramic layers, as disclosed in laid-open Publication No. 62-176043 of unexamined Japanese Patent Application.

While the end caps may be fitted in the corresponding end portions of the ceramic arc tube, by utilizing shrinkage of the arc tube during firing thereof, one of the opposite open ends of the arc tube is generally closed by the appropriate end cap and sealed by a suitable sealing layer after the tube is charged with a suitable metal halide and other substances. The sealing layer is provided to seal a clearance between the end cap and the inner surface of the appropriate end portion of the arc tube. To avoid evaporation or scattering of the metal halide and other contents of the arc tube, the sealing operation is commonly effected by rapidly heating the appropriate end portion of the arc tube and the corresponding end cap to about 1500° C., and by rapidly cooling the heated portion of the tube and the end cap.

In the HID lamp wherein the sealing material is used for sealing at least one of the opposite open ends of the arc tube, the sealing material provided to fill a clearance between the end portion of the tube and the end cap is likely to be exposed on the inner surface of the end cap. The sealing layer is corroded at its exposed portion by the metal halide vapor within the ceramic envelope device, whereby the sealing function of the sealing layer is lowered, causing leakage of the contents of the envelope device, and deteriorated operating characteristics of the lamp, such as lowered luminous efficacy (blackening of the wall of the translucent arc tube), and changes of color and operating voltage. Thus, the exposure of the sealing material to the inner space of the envelope device has adverse influences on the lamp.

To solve the above problem, the applicants proposed a ceramic envelope device for an HID lamp, as disclosed in copending U.S. patent application Ser. No. 07/135,255, filed Dec. 21, 1987, now U.S. Pat. No. 4,808,881, wherein the end portion of the ceramic arc tube which is gas-tightly sealed by a sealing layer is provided with a stepped portion a suitable distance inward of the end face of the tube. The stepped portion has an annular shoulder surface which extends from the inner surface of the tube in the radially inward direction. The outer peripheral portion of the inner surface of the appropriate end cap is held in direct abutting contact with the annular shoulder surface of the arc tube, so that the sealing layer is substantially isolated from the inner space of the envelope device.

In the HID lamp equipped with the thus constructed ceramic envelope device wherein the sealing material is isolated from the inner space, the sealing layer is protected from corrosion by the metal halide vapor, and the resultant drawbacks are effectively eliminated.

However, further study and analysis by the applicants on the above-proposed envelope device showed high possibility of cracking at the end section of the arc tube, in the presence of the stepped portion having a shoulder surface which is defined by two different inside diameters of the different axial portions adjacent to the shoulder surface. Namely, the end portion of the arc tube is likely to have a variation in heat capacity in the axial direction of the tube, due to inconsistency in the wall thickness of the stepped portion in the circumferential direction of the tube, and a difference in the wall thickness or inside diameter between the different axial portions adjacent to the stepped portion. The above variation in the heat capacity may cause cracking of the end section of the arc tube during heat treatment for gas-tight sealing of the appropriate end of the tube with the sealing material In this respect, the proposed ceramic envelope device has some room for further improvement.

SUMMARY OF THE INVENTION

The present invention was developed in light of the above-described situation. It is accordingly an object of the present invention to provide an improved ceramic envelope device for an HIP lamp, wherein the sealing material is isolated from the inner space of the envelope device, by a stepped portion at the open end section of the ceramic arc tube, and thereby protected from corrosion, and wherein the open end section of the arc tube is constructed for minimum cracking during sealing at an elevated temperature.

It is a second object of the present invention to provide a method suitable for producing such an improved ceramic envelope device.

The first object may be attained according to one aspect of the present invention, which provides a ceramic envelope device for a high-pressure metal-vapor discharge lamp, wherein a translucent ceramic arc tube is closed at longitudinally spaced opposite end sections thereof by respective end caps which support respective discharge electrodes on inner surfaces thereof, at least one of the opposite end sections of the arc tube being sealed with a sealing layer, wherein the improvement comprises: each of the at least one of the opposite end sections of the arc tube including a first axial portion which comprises an end face of each end section of the arc tube and which has a first inside diameter, and further including a second axial portion which has a second inside diameter smaller than the first inside diameter and which is disposed adjacent to and axially inwardly of the first axial portion, the first and second axial portions defining an annular shoulder surface which substantially radially inwardly extends between the first and second inside diameters; the first axial portion having a cylindrical wall thickness of 1.0–1.5 mm, and the annular shoulder surface having a radial width of 0.2–0.8 mm; and the sealing layer being interposed between the first axial portion of the arc tube and the corresponding end cap. The inner surface of the corresponding end cap includes a peripheral portion which is held in abutting contact with the annular shoulder surface, thereby substantially isolating the sealing layer from an inner space in which the discharge electrodes protrude.

In the ceramic envelope device of the present invention constructed as described above, the first and second axial portions and annular shoulder surface of each end section of the ceramic arc tube sealed by the sealing layer are dimensioned so as to minimize the possibility of cracking of the arc tube at its end section during heat treatment thereof for sealing with the sealing material. Accordingly, the HID lamp using the instant ceramic envelope device is significantly improved in quality and yield of production. Further, the abutting contact of the inner surface of the end cap with the annular shoulder surface of the arc tube effectively prevents the sealing layer from being exposed to the inner space of the envelope device in which the discharge electrode protrude, whereby deterioration of the sealing layer and resulting leakage of the envelope device are effectively and reliably avoided.

The second object indicated above may be accomplished according to another aspect of the invention, which provides a method of producing a ceramic envelope device constructed as described above, wherein a blank for the translucent ceramic arc tube is prepared such that the blank has dimensions corresponding to those of the arc tube, and a stepped-diameter drill is prepared such that the drill includes a proximal large-diameter portion whose helical grooves have an outside diameter corresponding to the first inside diameter of the first axial portion of the arc tube, and a distal small-diameter portion formed adjacent to the proximal large-diameter portion. The distal small-diameter portion has helical grooves whose outside diameter corresponds to the second inside diameter of the second axial portion of the arc tube. Each of at least one of longitudinally spaced end sections of the blank corresponding to each of the above-indicated at least one of the opposite end sections of the arc tube is drilled by the stepped-diameter drill, such that a first and a second hole which have respective diameters corresponding to the first and second inside diameters of the first and second axial portions, respectively, are formed by the proximal large-diameter and distal small-diameter portions, respectively, while the drill is fed in an axial direction thereof in one pass into the end section of the blank, whereby the arc tube having the first and second axial portions and the annular shoulder surface is formed from the blank drilled by the drill.

The instant method employing the stepped-diameter drill permits an extremely easy and accurate drilling operation on the blank of the arc tube, and therefore assures high precision in radial alignment or concentricity of the first and second axial portions at the end section of the arc tube. Accordingly, the ceramic envelope device for an HID lamp produced by the method of the invention exhibits improved operating stability and reliability.

BRIEF DESCRIPTION OF THE DRAWINGS

The above and optional objects, features and advantages of the present invention will be better understood by reading the following detailed description of presently preferred embodiments of the invention, when considered in connection with the accompanying drawings, in which.

DETAILED DESCRIPTION OF THE PREFERRED EMBODIMENTS

To further clarify the present invention, the preferred embodiments of the invention will be described in detail, by reference to the accompanying drawings.

Figure 1:
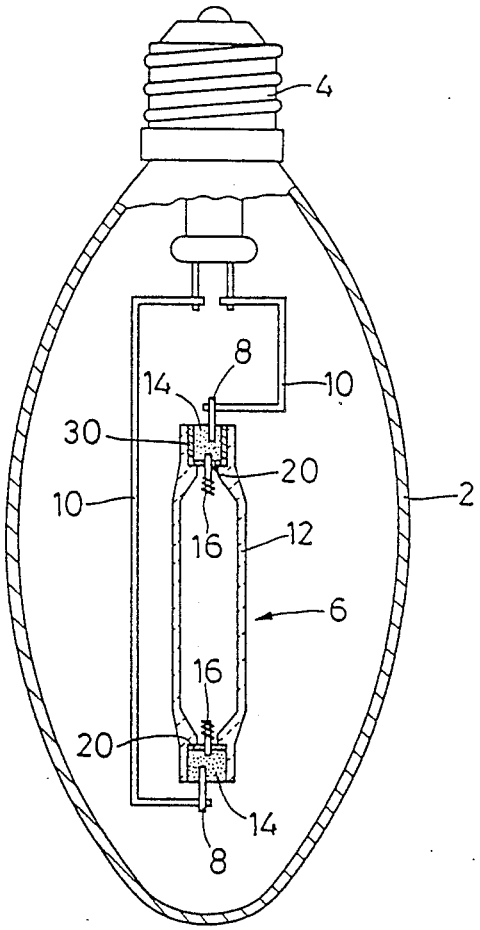
FIG. 1 is a schematic elevational view, partly in cross section, of an example of an HID lamp incorporating one embodiment of a ceramic envelope device of the present invention.

Referring first to FIG. 1, there is schematically illustrated a complete assembly of an HID lamp. In the figure, reference numeral 2 denotes a bulbiform translucent jacket which is commonly made of a glass or similar material. This translucent jacket 2 accommodates therein a ceramic envelope device 6, and is closed at its open end by a base 4. The jacket 2 and the base 4 cooperate to provide a gas-tight enclosure which is charged with a suitable inert gas such as nitrogen, or maintained under vacuum. As is well known in the art, electric power applied to the base 4 is supplied, via electrical conductors 10, 10, to electrical lead rods 8, 8 which are disposed at the longitudinally spaced opposite ends of the ceramic envelope device 6 accommodated in the jacket 2. The envelope device 6 is fixed in the jacket 2 by the electrical conductors 10.

The ceramic envelope device 6 includes a translucent ceramic arc tube 12 made of alumina or other ceramic material, and a pair of closure discs in the form of end caps 14, 14 made of an electrically conductive cermet. The end caps 14 are secured to the longitudinally spaced opposite ends of the ceramic arc tube 12, such that the end caps 14 close the opposite ends of the arc tube 12, so as to maintain gas tightness of the ceramic envelope device 6. The gas-tight ceramic envelope device 6 is charged with a suitable gas, and a suitable metal or its compound selected depending upon the specific type of the HID lamp. In the case of a high-pressure sodium lamp, for example, the ceramic envelope device 6 is charged with metallic sodium, mercury and rare gas. In a metal halide lamp, the envelope device 6 is charged with a metal halide, as well as mercury and rare gas.

In the present embodiment, the upper end of the ceramic arc tube 12 (as viewed in FIG. 1) is closed by the upper end cap 14 and sealed by a sealing layer 30, while the lower end cap 14 (as viewed in FIG. 1) is shrink-fitted in the lower end of the arc tube 12, by means of shrinkage of the tube 12 and end cap 14 during sintering thereof. Each of the two electrical lead rods 8 is embedded at its fixed end in the outer portion of the corresponding end cap 14, such that the free end of the lead rod 8 protrudes outwardly from the outer surface of the end cap 14. The ceramic envelope device 6 has a pair of discharge electrodes 16, 16, each of which is embedded at its fixed end in the inner portion of the corresponding end cap 14, such that the free end protrudes from the inner surface (indicated at 18 in FIG. 2) of the corresponding end cap 14, longitudinally inwardly in the arc tube 12.

Each of the electrical lead rods 8 and the discharge electrodes 16 is formed of a refractory material such as tungsten, while the end caps 14 are formed of a known cermet. For example, the end caps 14 are suitably formed of $Al_2O_3$-W cermet or $Al_2O_3$-Mo cermet whose coefficient of thermal expansion is intermediate between those of the ceramic material of the arc tube 12 and the refractory material of the lead rods 8 and electrodes 16.

An electrically insulating layer (electrical insulator) 20 having a suitable thickness is formed on the inner surface of each end cap 14, in order to prevent the well known "arc-back" phenomenon. Described more specifically, the insulating layer 20 covers substantially the entire area of the inner surface of the end cap 14, namely, covers the inner surface except for a central portion thereof around the corresponding discharge electrode 16. The insulating layer 20 is formed of a suitable refractory ceramic material such as alumina, beryllia, spinel or boron nitride. In particular, the insulating layer 20 is preferably formed of a substantially electrically insulating cermet prepared from powdered mixture of such a refractory ceramic material as indicated above and a suitable metal such as tungsten or molybdenum. In this case, cracking of the insulating layer 20 may be effectively avoided.

A salient feature of the instant ceramic envelope device 6 resides in the configuration of the upper end portion of the ceramic arc tube 12 in which the upper end cap 14 is fitted via the sealing layer 30. The upper end portion of the envelope device 6 is illustrated in detail in FIG. 2.

Figure 2:
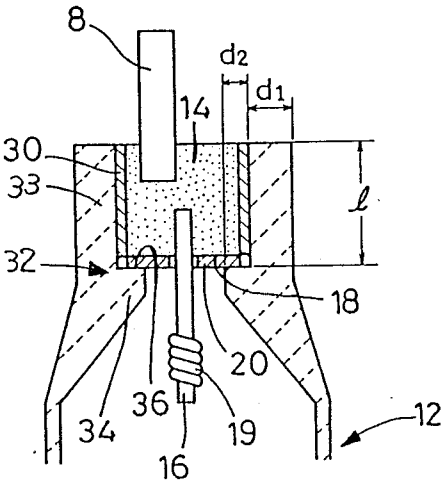
FIG. 2 is an enlarged fragmentary view in cross section of an upper end portion of the ceramic envelope device of the HID lamp of FIG. 1.

As is apparent from FIG. 2, the ceramic arc tube 12 is formed with an annular stepped portion 32 defined by a first axial portion 33 which includes the extreme upper end face and which has a first inside diameter, and a second axial portion 34 which extends from the inner end of the first axial portion 33 in the radially inward direction and which has a second inside diameter smaller than the first inside diameter. More particularly, the stepped portion 32 has an annular shoulder surface 36 formed concentrically between the first and second axial portions 33, 34. The shoulder surface 36 is spaced from the upper end face of the arc tube 12 by a suitable distance in the longitudinal direction of the arc tube 12.

The upper end cap 14 fitted in the thus constructed upper end portion of the arc tube 12 has an outside diameter which is intermediate between the first and second inside diameters of the first and second axial portions 33, 34, preferably only slightly smaller than the first inside diameter of the first axial portion 33. Namely, the outside diameter of the upper end cap 14 is smaller than the first inside diameter by a small amount which corresponds to the thickness of the sealing layer 30. According to this arrangement, the outer peripheral portion of the insulating layer 20 formed on the inner surface 18 of the end cap 14 is held in direct abutting contact with the shoulder surface 36 of the stepped portion 32 between the first and second axial portions 33, 34, over the entire circumference of the shoulder surface 36.

The sealing layer 30 for providing gas tight sealing between the upper end cap 14 and the upper end portion of the ceramic arc tube 12 consists of a suitable known composition which is resistant to a metal halide. For instance, the sealing layer 30 is formed of a composition which consists of a mixture of materials selected from the group including $Y_2O_3$, $La_2O_3$, $Dy_2O_3$, $Al_2O_3$ and $SiO_2$, the proportions of the materials being suitably selected.

With the direct abutting contact between the shoulder surface 36 of the stepped portion 32 of the ceramic arc tube 12 and the outer peripheral portion of the inner surface 18 of the upper end cap 14 (more precisely, the outer peripheral portion of the insulating layer 20), the sealing layer 30 is substantially completely isolated protected from exposure to a corrosive metal halide vapor, whereby corrosion of the sealing layer 30 is substantially avoided.

In the instant embodiment, the first axial portion 33 of the arc tube 12 preferably has a cylindrical wall thickness d1 of 1.0–1.5 mm, while the shoulder surface 36 of the stepped portion 32 defined, by the first and second axial portions 33, 34 preferably has a radial width d2 of 0.2–0.8 mm.

The radial width d2 of the shoulder surface 36 of the stepped portion 32 is preferably as large as possible, for the purpose of isolating the sealing layer 30 from the inner space within the arc tube 12, with the inner surface 18 of the end cap 14 held in contact with the shoulder surface 36, and from the standpoint of ease of manufacture of the arc tube 12. However, increasing the radial width d2 of the shoulder surface 36 results in an increase in differences in the wall thickness and heat capacity between the first and second axial portions 33, 34 of the arc tube 12, and consequently an increase in a difference in the thermal expansion coefficient between these two axial portions 33, 34, whereby the upper end section of the upper end cap 14 is likely to crack when it is heated for gas tight sealing during assembling of the end cap 14 and the arc tube 12.

Described in greater detail, the sealing layer 30 is formed between the upper end cap 14 and the upper end section of the arc tube 12, by heating a sealing member in the form of a ring interposed between the tube 12 and the end cap 14, to a temperature of about 1500° C. in an atmosphere of argon. This sealing process is desirably effected with fast heating and cooling of the upper end section of the arc tube 12, for avoiding evaporation or scattering of a metal halide contained in the tube 12. Therefore, an increase in the radial width d2 of the shoulder surface 36 increases the tendency of the upper end section of the arc tube 12 to crack due to the difference in the heat capacity and thermal expansion coefficient between the first and second axial portions 33, 34.

Extensive experiments and careful studies conducted by the applicants revealed that the dimensioning of the upper end section of the end cap 14 as described above was extremely effective to prevent the cracking of the arc tube 12 during the sealing operation.

Accordingly, the quality of the ceramic envelope device 6 is stabilized, and the yield of the product is significantly improved, with a minimum ratio of rejection due to the cracking. Further, the instant ceramic envelope device 6 is free of deterioration of the sealing layer 30 due to its corrosion, and consequent leakage of the content of the arc tube 12.

A thermal shock test was conducted on various specimens of the ceramic envelope device 6 with the alumina ceramic arc tube 12, whose wall thickness d1 of the first axial portion 33 and radial width d2 of the shoulder surface 36 are indicated in Table 1. In the test, the upper end section of the arc tube 12 and the upper end cap 14 were subjected to a heat treatment (heating to 1500° C. in two minutes) which is usually employed for sealing the arc tube 12. Cracking and sealing conditions of the tested specimens are also indicated in Table 1. In all the specimens, a distance l (FIG. 2) between the upper end face of the arc tube 12 and the shoulder surface 36 was 2.0 mm.

TABLE 1

| | d1 (mm) | d2 (mm) | Observation |
|---|---|---|---|
| Comparative | 0.8 | 0.4 | Cracking observed |
| Invention | 1.0 | 0.4 | No cracking observed |
| | 1.3 | 0.4 | No cracking observed |
| | 1.5 | 0.4 | No cracking observed |
| Comparative | 2.0 | 0.4 | Poor frit sealing |
| Invention | 1.3 | 0.1 | Frit exposed to inner space of arc tube |
| | 1.3 | 0.2 | No cracking observed |
| | 1.3 | 0.4 | No cracking observed |
| | 1.3 | 0.8 | No cracking observed |
| Comparative | 1.3 | 1.0 | Cracking observed |

It will be understood from Table 1 that the dimensioning of the upper end section of the arc tube 12 according to the principle of the invention is effective to prevent cracking of the arc tube 12. The thermal shock test revealed that the wall thickness d1 of less than 1.0 mm of the first axial portion 33 will cause insufficient resistance of the portion 33 to thermal stresses, which results in easy cracking of the upper end section of the arc tube 12. The test also revealed that the wall thickness d1 exceeding 1.5 mm will cause an excessively large amount of heat capacity of the portion 33, which makes it difficult to obtain a satisfactory gas tight seal between the upper end cap 14 and the upper end section of the arc tube 12, by the heat treatment. It was also revealed that the radial width d2 of less than 0.2 mm of the shoulder surface 36 will lead considerable difficulty in forming the upper end section of the arc tube 12 and attaining the original purpose of preventing the sealing layer 30 from being exposed to the inner space within the arc tube 12. The test further showed that the upper end section of the arc tube 12 tends to easily crack due to an excessive amount of difference in the heat capacity between the first and second axial portions 33, 34, when the radial width d2 exceeds 0.8 mm.

It is also desirable that the length l of the first axial portion 33 (distance between the upper end face and the shoulder surface 36) of the arc tube 12 be held within a range of 1.0–3.0 mm. The distance of less than 1.0 mm will cause insufficient reliability of gas tight sealing at the upper end section of the arc tube 12, while the distance exceeding 3.0 mm will cause poor thermal stress resistance of the upper end section of the arc tube 12, which results in increased possibility of cracking of the arc tube.

Figure 4:
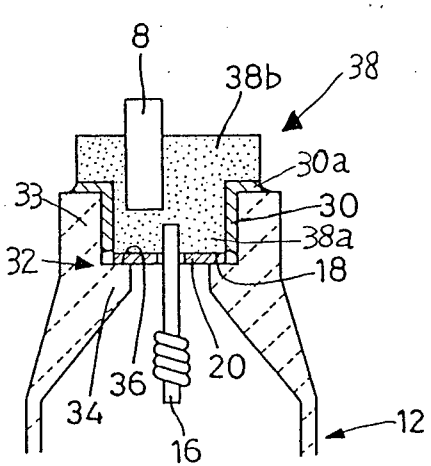
FIG. 4 is an enlarged fragmentary cross sectional view corresponding to that of FIG. 2, showing another embodiment of the ceramic envelope device of the invention for an HID lamp.

A sufficient degree of gas tightness at the upper end section of the arc tube 12 may be obtained according to a modified embodiment of the invention shown in FIG. 4, even if the length l of the first axial portion 33 is relatively small. This modified embodiment uses a stepped upper end cap 38 which consists of an inner portion 38*a* which is substantially entirely fitted in the first axial portion 33 of the arc tube 12, and an outer portion 38*b* which has a larger diameter than the inner portion 38*a* and which is positioned outside the arc tube 12. In this case, the sealing layer 30 includes a radially outwardly extending annular flange portion 30*a* formed between the shoulder surface of the end cap 38 and the upper end face of the arc tube 12. Thus, the end cap 38 has a larger surface area than the upper end cap 14 shown in FIG. 2. In FIG. 4, the same reference numerals as used in FIG. 2 are used to identify the functionally corresponding elements, except for the modified end cap 38, in the interest of easy understanding.

There will be described an example of a method for fabricating the ceramic arc tube 12 of FIG. 2 of the ceramic envelope device.

Figure 3:
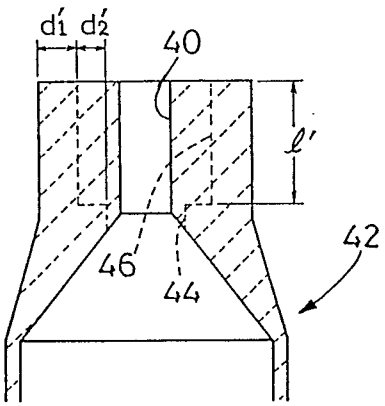
FIG. 3 is an enlarged fragmentary view of an end portion of a blank for a ceramic arc tube of the ceramic envelope device, showing a configuration and the dimensions of the corresponding end portion of the arc tube.

Referring to FIG. 3, there is prepared a tubular blank or workpiece in the form of a formed ceramic body 42 made of a suitable ceramic material. The ceramic body 42 has a bore 40 having a relatively small diameter formed through the upper end portion, such that the bore 40 communicates with the inner space defined in the longitudinally intermediate portion of the ceramic body 42. The ceramic body 42 may be a dried, semi-fired or fired article. The bored upper end portion of the ceramic body 42 is drilled by a drill in the longitudinal direction of the body 42, to first form a relatively small hole 44 whose diameter corresponds to the second inside diameter of the second axial portion 34 of the arc tube 12. Then, a relatively large hole 46 whose diameter corresponds to the first inside diameter of the first axial portion 33 of the arc tube 12 is formed by another drill, concentrically with the already cut relatively small hole 44, such that the depth l' of the hole 46 corresponds to the length of the first axial portion 33. The diameter of the hole 46 is determined such that a wall thickness d'1 and a radial width d'2 as indicated in FIG. 3 correspond to the dimensions d1 and d2 of the arc tube 12. The thus machined ceramic body 42 is fired as desired, if necessary. The upper end section of the arc tube 12 is thus formed.

In the above method, however, the relatively small and large holes 44, 46 are cut in separate drilling operations using two drills which have different diameters defined by flutes or helical grooves. Accordingly, the holes 44, 46 are likely to suffer from some radial misalignment or poor concentricity, due to radial misalignment of the two drills when they are changed from one to the other.

Since the above method inevitably experiences more or less the radial misalignment of the two holes 44, 46, it is extremely difficult to obtain consistency in the radial width d2 of the shoulder surface 36 of the arc tube 12 over its entire circumference. Where the radial width d2 is comparatively small, a variation in the radial width d2 in the circumferential direction of the shoulder surface 36 leads to increased possibility of the sealing material (30) being exposed to the inner space of the ceramic envelope device 6, which is a big barrier for the stepped portion 32 (shoulder surface 36) to serve its purpose.

Figure 5:
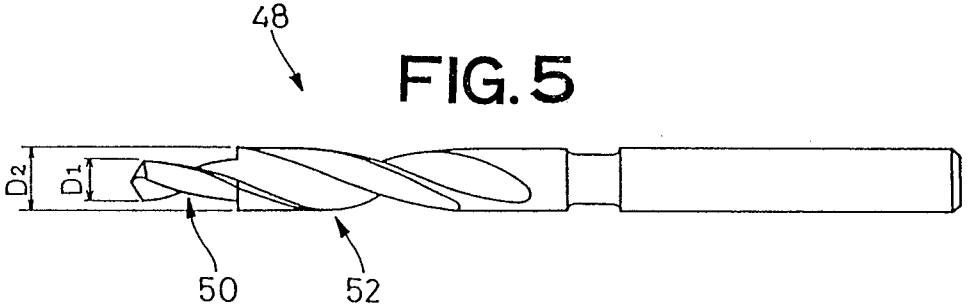
FIG. 5 is a plan view of a stepped-diameter drill suitably used to prepare the ceramic arc tubes of FIGS. 2 and 4.

In view of the above drawback, the method according to the instant embodiment of the invention uses a stepped-diameter drill 48 as shown in FIG. 5, for drilling the holes 44 and 46 for forming the upper end section of the arc tube 12 which has the stepped portion 34. The drill 48 has two sets of helical grooves which are separated from each other at an axially intermediate portion of the body. The set of helical grooves on the proximal side of the drill has a diameter which is larger than that on the distal side, by an amount equal to the difference between the diameters of the holes 44, 46.

Described more specifically, the stepped-diameter drill 48 includes a distal small-diameter portion 50 having a diameter D1 corresponding to the diameter of the relatively small hole 44, and a proximal large-diameter portion 52 having a diameter D2 corresponding to the diameter of the relatively large hole 46. This drill 48 permits drilling of the two holes 44, 46 in one drilling pass into the upper end portion of the formed ceramic body 42, while the drill 48 is fed in its axial or longitudinal direction. Thus, the method using the drill 48 completely eliminates radial misalignment or concentricity error between the drilled holes 44, 46.

Thus, the instant method not only permits efficient fabrication of the ceramic arc tube 12, but also assures a high degree of consistency in the radial width d2 of the formed shoulder surface 36 over its entire circumference, even if the radial width d2 is relatively small. Consequently, the method assures improved production efficiency and enhanced quality of the ceramic envelope device 6.

While the cutting edges at the tip of the proximal large-diameter portion 52 of the drill 48 used in the illustrated embodiment are almost perpendicular to the axis of the drill, the tip of the large-diameter portion 52 may have a suitable lip clearance angle. In this case, it is desirable that the outer peripheral portion of the inner surface 18 of the upper end cap 14 be tapered into agreement with the lip clearance angle.

While the present invention has been described in its typically preferred embodiments, it is to be understood that the invention is not limited to the details of the illustrated construction and method and the related test results, but the invention may be embodied with various changes, modifications and improvements, which may occur to those skilled in the art, without departing from the spirit and scope of the invention.

For instance, the end caps 14 formed of a cermet material in the illustrated embodiments may be replaced by end caps as shown in the above-identified laid-open Publication No. 62-176043, which have a laminar structure consisting of ceramic layers and an electrically conductive layer disposed between the ceramic layers. In this case, the well known "arc-back" phenomenon may be effectively prevented without the electrically insulating layer 20 as provided in the illustrated embodiments.

Further, the arc tube 12 may be produced by first forming preliminary holes in the dried or semi-fired ceramic body 42, by using a stepped-diameter drill similar to the drill 48, such that the diameters of the preliminary holes are smaller than the inside diameters of the first and second axial portions 33, 34 of the produced arc tube 12. Then, the ceramic body 42 is fired as needed, and the preliminary holes are finished by a similar stepped-diameter drill, to the predetermined inside diameters of the axial portions 33, 34. In this case, the dimensional error due to shrinkage of the ceramic body 42 during firing thereof may be eliminated, whereby the dimensional accuracy of the arc tube 12 may be further improved.

What is claimed is:

1. A ceramic envelope device for a high-pressure metal-vapor discharge lamp, wherein a translucent ceramic arc tube is closed at longitudinally spaced opposite end sections thereof by respective end caps which support respective discharge electrodes on inner surfaces thereof, at least one of said opposite end sections of the arc tube being sealed with a sealing layer, wherein the improvement comprises:

each of said at least one of the opposite end sections of said arc tube including a first axial portion which comprises an end face of said each end section and which has a first inside diameter, and a second axial portion which has a second inside diameter smaller than said first inside diameter and which is disposed adjacent to and axially inwardly of said first axial portion, said first and second axial portions defining an annular shoulder surface which substantially radially inwardly extends between said first and second inside diameters;

said first axial portion having a cylindrical wall thickness of 1.0–1.5 mm, and said annular shoulder surface having a radial width of 0.2–0.8 mm; and said sealing layer being interposed between said first axial portion of said arc tube and the corresponding end cap, said inner surface of said corresponding end cap including a peripheral portion which is held in abutting contact with said annular shoulder surface, thereby substantially isolating said sealing layer from an inner space in which said discharge electrodes protrude.

2. A ceramic envelope device according to claim 1, wherein said first axial portion of said arc tube has an axial length of 1.0–3.0 mm between said end face of the arc tube and said annular shoulder surface.

3. A ceramic envelope device according to claim 1, wherein said corresponding end cap has a small-diameter inner portion substantially fitted in said first axial portion of the arc tube, and a large-diameter outer portion which has a larger outside diameter than said small-diameter inner portion and which is located outside said arc tube, said sealing layer including a radially outwardly extending annular flange portion formed between said end face of the arc tube, and a shoulder surface of said corresponding end cap defined by said inner and outer portions.

4. A ceramic envelope device according to claim 1, wherein said inner surface of said corresponding end cap is covered by an electrically insulating layer, except for a portion of said inner surface around the corresponding discharge electrode, said annular shoulder surface being held in abutting contact with a peripheral portion of said electrically insulating layer.

5. A method of producing a ceramic envelope device as defined in claim 1, comprising the steps of:

preparing a blank for said translucent ceramic arc tube such that said blank has dimensions corresponding to those of said arc tube;

preparing a stepped-diameter drill such that said drill includes a proximal large-diameter portion whose helical grooves have an outside diameter corresponding to said first inside diameter of said first axial portion of said arc tube, and a distal small-diameter portion formed adjacent to said proximal large-diameter portion, said distal small-diameter portion having helical grooves whose outside diameter corresponds to said second inside diameter of said second axial portion of the arc tube; and drilling each of at least one of longitudinally spaced end sections of said blank corresponding to said each of said at least one of the opposite end sections of the arc tube, by said stepped-diameter drill, such that a first and a second hole which have respective diameters corresponding to said first and second inside diameters of said first and second axial portions, respectively, are formed by said proximal large-diameter and distal small-diameter portions, respectively, while said drill is fed in an axial direction thereof in one pass into said each of said at least one of end sections of the blank, whereby said arc tube having said first and second axial portions and said annular shoulder surface is formed from said blank drilled by said drill.

6. A method according to claim 5, wherein said proximal large-diameter portion of said stepped-diameter drill has a tip adjacent to an end of said distal small-diameter portion remote from a tip of said small-diameter portion, said tip of said proximal large-diameter portion having cutting edges which are substantially perpendicular to said axial direction of the drill, whereby said annular shoulder surface of said arc tube is formed substantially perpendicular to an axis of the arc tube.

7. A method according to claim 5, wherein said proximal large-diameter portion of said stepped-diameter drill has a tip adjacent to an end of said distal small-diameter portion remote from a tip of said small-diameter portion, said tip of said proximal large-diameter portion having a lip clearance angle so that said annular shoulder surface of said arc tube is inclined at an angle corresponding to said lip clearance angle relative to a plane perpendicular to an axis of the arc tube.

8. A method according to claim 5, wherein said each end section of said blank is drilled by said stepped-diameter drill before said blank is fired into said arc tube.

9. A method according to claim 5, wherein said each end section of said blank is drilled by said stepped-diameter drill after said blank is fired into said arc tube.

10. A method according to claim 9, further comprising a step of drilling said each end section of said blank before firing said blank, by another drill which is similar to said stepped-diameter drill but has smaller outside diameters corresponding to those of said proximal and distal portions of said stepped-diameter drill.

* * * * *